United States Patent [19]

Thorne

[11] 4,059,147

[45] Nov. 22, 1977

[54] INTEGRAL FINNED TUBE FOR SUBMERGED BOILING APPLICATIONS HAVING SPECIAL O.D. AND/OR I.D. ENHANCEMENT

[75] Inventor: John K. Thorne, Decatur, Ala.

[73] Assignee: Universal Oil Products Company, Des Plaines, Ill.

[21] Appl. No.: 432,042

[22] Filed: Jan. 9, 1974

Related U.S. Application Data

[63] Continuation-in-part of Ser. No. 271,835, July 14, 1972, abandoned.

[51] Int. Cl.[2] ..... F28F 13/18; F28F 1/42; F28F 1/36; F28F 1/26

[52] U.S. Cl. ..... 165/133; 165/179

[58] Field of Search ..... 165/133, 179

[56] References Cited

U.S. PATENT DOCUMENTS

| | | | |
|---|---|---|---|
| 3,217,799 | 11/1965 | Rodgers | 165/179 |
| 3,481,394 | 12/1969 | Withers, Jr. | 165/179 |
| 3,496,752 | 2/1970 | Kun et al. | 165/133 |
| 3,566,514 | 3/1971 | Szumigala | 165/133 X |
| 3,696,861 | 10/1972 | Webb | 165/133 |
| 3,768,290 | 10/1973 | Zatell | 165/133 |
| 3,768,291 | 10/1973 | Rieger | 165/179 |

*Primary Examiner*—Ronald H. Lazarus
*Assistant Examiner*—S. J. Richter
*Attorney, Agent, or Firm*—Whittemore, Hulbert & Belknap

[57] ABSTRACT

Heat transfer tubing adapted to be submerged in a liquid to be boiled as a result of transfer of heat from the interior of the tube to the liquid. The exterior of the tubing has elongated circumferentially extending confined spaces of substantially uniform cross-section and provided with effectively continuous circumferentially extending elongated restricted openings provided at circumferentially spaced zones with substantial enlargements.

9 Claims, 11 Drawing Figures

FIG. 1
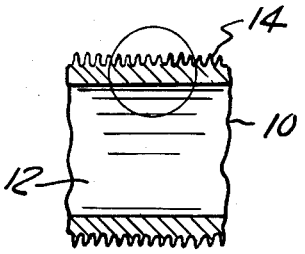
FIG. 2
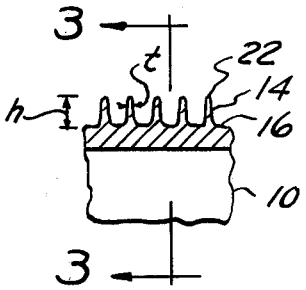
FIG. 3
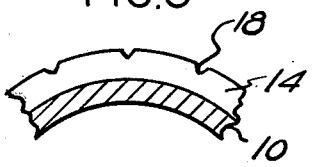
FIG. 4
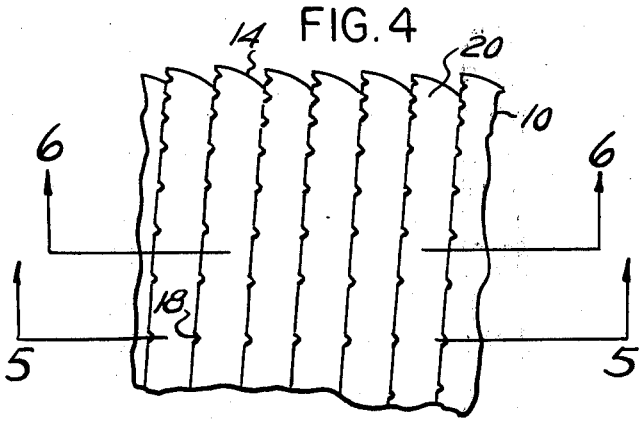
FIG. 5
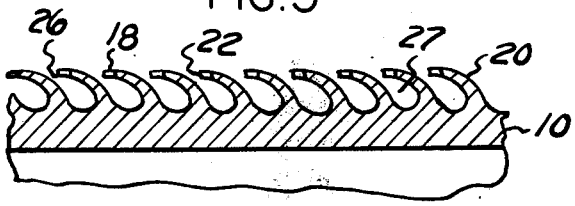
FIG. 7
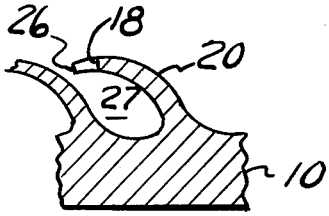
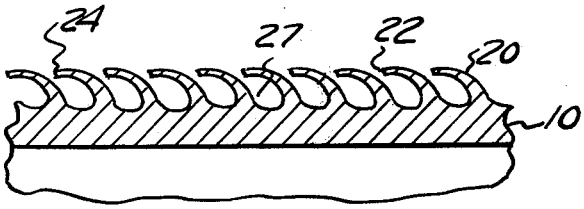
FIG. 6

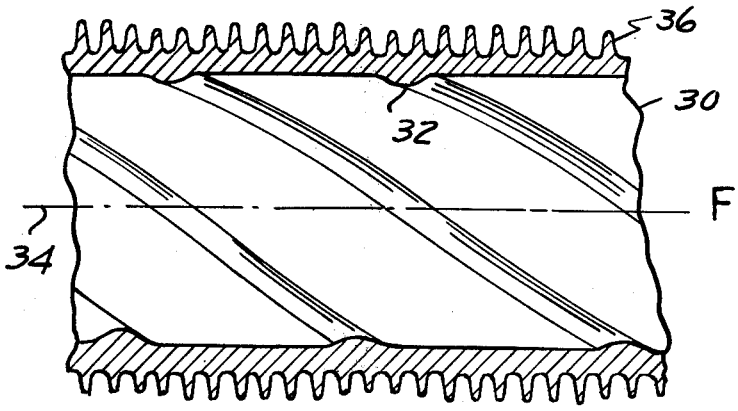
FIG. 8
FIG. 9
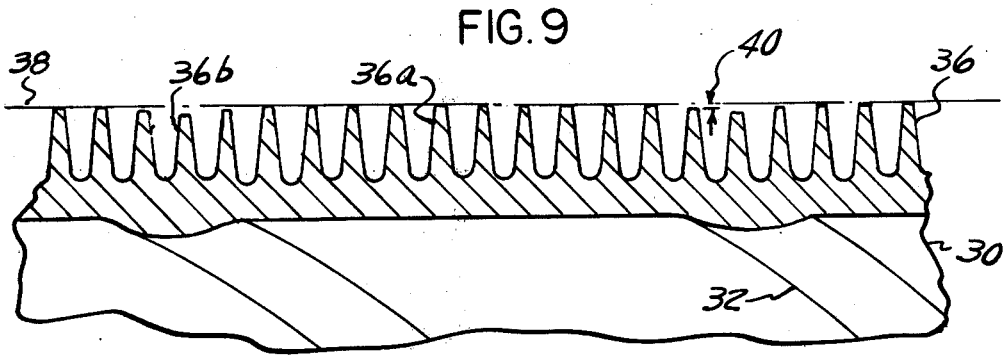
FIG. 10
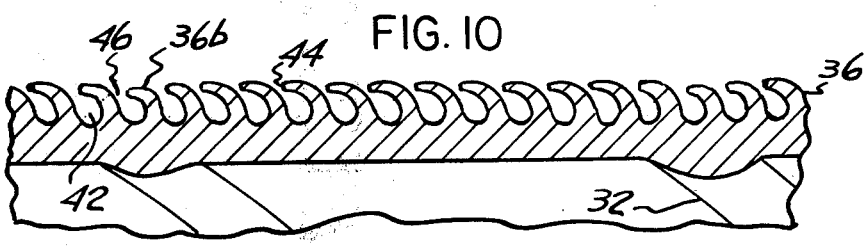
FIG. 11
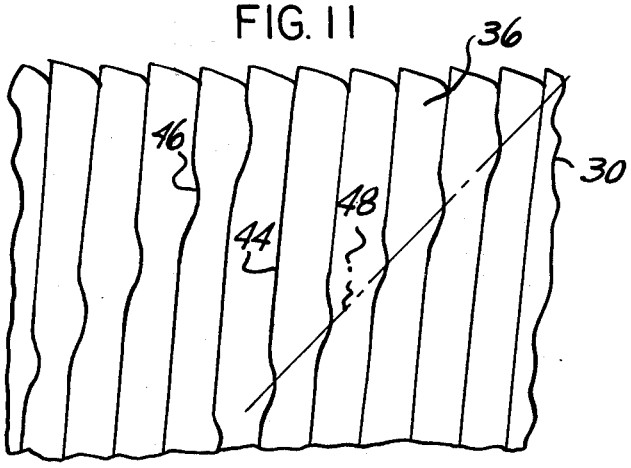

INTEGRAL FINNED TUBE FOR SUBMERGED BOILING APPLICATIONS HAVING SPECIAL O.D. AND/OR I.D. ENHANCEMENT

CROSS-REFERENCE TO RELATED APPLICATION

This application is a Continuation-in-Part of my prior co-pending application Ser. No. 271,835, filed July 14, 1972, now abandoned.

BRIEF SUMMARY OF THE INVENTION

The present invention concerns a special integrally finned tubing having a specific geometry whereby the rate of heat transfer is enhanced in certain submerged boiling applications.

More specifically, the tubing has the fin convolutions bent over so that the tips of each convolution is brought into closely spaced relation to the side of the adjacent convolution and defines therewith elongated circumferentially extending substantially confined spaces having effectively continuous circumferentially extending elongated restricted openings communicating with said spaces, and characterized in that at circumferentially spaced zones of limited extent the bent over tip portions of the fin convolutions are shaped to define substantial enlargements in said openings.

In one embodiment of the present invention plain tubing is provided with fins, preferably helical in configuration, by a fin rolling operation well known in the art. The fin convolutions as produced by this rolling operation are of uniform height and if bent over as suggested in Zatell U.S. Pat. No. 3,768,290, would produce an effectively uniform restricted opening leading into the confined space defined between adjacent fins. In accordance with the present invention the height of the fins is reduced at circumferentially spaced points so that when the fins are bent over, the fin portions of reduced height define with the adjacent fin convolution enlargements in the effectively continuous circumferentially extending openings into the confined space.

In conventional finning operations as carried out commercially, fins of substantially uniform cross-section and spacing are produced, and when the fins are bent over uniformly, as contemplated herein, the partly enclosed spaces between adjacent fin convolutions are of uniform cross-section. Moreover, the gap or opening into the partly enclosed spaces are of substantially uniform width except where the fin height is reduced. Finally, the reduction in fin height is at uniformly spaced zones and has substantially the same shape and dimension at each zone of reduced fin height.

Since the fin dimensions and spacing may be accurately controlled, it is possible to provide for accurate control of the dimensions of the generally circumferentially extending partly enclosed spaces, the width of the opening or gap leading into such spaces, and the dimensions and spacing between adjacent enlarged portions of the gap or opening.

The initially uniform height fins may have portions reduced in height by a knurling operation applied longitudinally of the finned tube. This knurling operation presses the metal of the tip or crest portions of the fins downwardly to produce circumferentially spaced fin portions of reduced height. Alternatively of course, the fin portions of reduced height may be produced by removing material at circumferentially spaced zones along the fins by metal removing operations such as cutting or grinding.

The tubing of the present invention is completed by drawing the tubing provided with the modified fins through a properly sized die so as to deform or bend over the fin convolutions to provide the required restricted opening into the confined spaces defined between adjacent tube convolutions.

In a preferred embodiment of the present invention the initial fin forming operation is carried out as suggested in Rieger U.S. Pat. No. 3,768,291, in which the plain tubing is supported on helically grooved mandrels as radially inwardly applied pressure is applied thereto to roll up fins. Where the fin rolling pressure is applied over a grooved portion of the mandrel, material of the plain tube is disposed into the mandrel and at this portion of the tubing the fin height is slightly reduced. This reduced fin height is not particularly significant in the tubing disclosed in the Rieger patent, but where the Rieger method is employed as the first step of producing specifically modified fins in the method disclosed herein, the slight reduction in fin height automatically provides circumferentially spaced enlargements in the effectively continuous circumferentially extending openings into the substantially confined spaced between adjacent fins, when the finned tubing is drawn through a die shaped to produce precisely the required deformation or bending over of the fin convolutions.

The provision of effectively continuous elongated circumferentially extended restricted openings into the partially confined spaces between adjacent fin convolutions, where the openings have circumferentially spaced enlargements is particularly useful in transfer of heat to effect boiling of a viscous liquid or a liquid containing froth or foam. In both cases, inward flow of liquid into the confined spaces between adjacent fins is permitted at the enlargements, whereas sufficient inflow of liquid through the more restricted opening portions might be insufficient for maximum efficient heat transfer.

The average width of the spacing between the fin crests and the sides of adjacent fins depends upon a number of factors and in any particular application may best be determined by experiment. However, in general terms it is believed that the average spacing, except for the zones of enlargement, should be less than 0.007 inch, and normally will be less than 0.005 inch. The width of the enlargements of the opening may also be dependent upon a number of factors, but in general it should not be less than 50% more than the average width of the opening intermediate the enlargements.

A particular example of the foregoing is a continuous opening having an average width of 0.004 inch and enlargements having an average width of 0.006 inch.

In addition, the total amount of the continuous opening occupied by the enlargement should be between 10 and 30% of the total opening.

BRIEF DESCRIPTION OF THE DRAWINGS

FIG. 1 is a fragmentary longitudinal section through a tube used in producing tubing embodying the present invention.

FIG. 2 is a fragmentary enlargement of the portion of the tube contained in the circle in FIG. 1.

FIG. 3 is a sectional view on the line 3—3, FIG. 2.

FIG. 4 is a fragmentary elevational view of a portion of a tube completed from the condition illustrated in FIGS. 1-3.

FIG. 5 is a fragmentary section on the line 5—5, FIG. 4.

FIG. 6 is a fragmentary section on the line 6—6, FIG. 4.

FIG. 7 is a fragmentary enlarged sectional view of the tubing as shown in FIG. 5.

FIG. 8 is a fragmentary sectional view through a tube used in producing tubing embodying a further embodiment of the present invention.

FIG. 9 is a fragmentary enlarged section of a portion of the tube shown in FIG. 8.

FIG. 10 is a view similar to FIG. 9, showing the condition of the tubing after it has been drawn through a die.

FIG. 11 is a fragmentary elevational view of the completed tube as illustrated in FIG. 10.

DETAILED DESCRIPTION

The heat exchange tubing illustrated herein represents a specific improvement over tubing as illustrated in prior Zatell U.S. Pat. No. 3,768,290, assigned to the assignee hereof. This tubing, as in the prior Zatell patent, is produced by drawing integrally finned tubing through a circular die in such a way as to bend the fin convolutions transversely so as to bring the tip of each fin convolution into proximity to the side wall of the adjacent fin convolution. This produces a substantially confined elongated space which extends substantially around the outside of the tubing. If the fins are separate circular fins, each space comprises a single annular space. If on the other hand, the fins are helical, then the confined spaces extend helically around the exterior of the tubing.

As disclosed in the prior Zatell patent, the crest or tip of each fin is spaced slightly from the side wall of the adjacent fin convolution so as to define an elongated circumferentially extending relatively narrow opening providing access to the interior of the substantially enclosed space for entry into the space of a liquid in which the tubing is submerged. The liquid which enters the substantially confined space is vaporized very efficiently and the resulting vapor is expelled from the space through the narrow opening into the body of the liquid in which the tubing is submerged.

Tubing of the type disclosed in the foregoing may be most efficiently manufactured by rolling up integral fins from the material of a plain tube, after which the finned tube is drawn through a die having the opening in the die effective to bend over the fins to produce the substantially confined spaces and to produce continuous or substantially continuous elongated circumferentially extending openings communicating with the confined space. As a practical matter, it is impossible to control the width of spacing with precision but it is sufficient to produce an action providing within reasonable limits an average width of space sufficient to provide for entry of the liquid to be boiled through the space into the confined opening, and of course, to provide for flow of the vapor resulting from boiling or vaporization of the liquid through the opening into the body of liquid in which the tubing is submerged.

In accordance with the present invention, there is specific provision of periodic or circumferentially spaced enlargements of substantially continuous opening. These enlargements provide for flow of certain liquids or fluid material into the confined spaces which would be insufficiently accomplished if the continuous or substantially continuous openings were of uniform average width and not provided with the spaced enlargements for flow of liquid into the confined spaces.

As disclosed in Zatell U.S. Pat. No. 3,768,290, the average width of the space or gap between the crests of a fin convolution and the adjacent surface of the next convolution should be up to 0.007 inches, and the maximum improvement in boiling efficiency is noted where the gap does not exceed 0.005 inches. In practice of course, the average width of the gap may be substantially less than 0.005 inches, as for example as noted for specific tubing in the prior patent, wherein gap widths as low as 0.001 inch were tested. Accordingly, the present invention provides for continuous elongated circumferentially extending openings communicating with the interior of the confined spaces extending around the tube in which, except for the enlargements hereinafter described, will have an average effective width not exceeding 0.007 inches and preferably not exceeding 0.005 inches, and in many cases substantially less, as for example 0.001 inches. The most effective width for a particular liquid to be boiled may be determined by experimentation within the limits herein suggested.

An average width for the continuous elongated access opening for most efficient operation for liquid provided within the enclosed space may be less than the width which will give the most efficient overall operation, because the narrowness of the opening or gap may be such as to restrict flow of liquid into the enclosed space for vaporization therein. Accordingly, the present invention teaches the provision of the elongated continuous opening into the confined space as having a width selected such as to produce a maximum heat transfer and consequent boiling enhancement, while at the same time provision is made in the form of circumferentially spaced enlargements for inflow of fluid from the body of liquid in which the tubing is submerged into the substantially confined circumferentially extending space.

In general terms, the width of the opening will be related to the average width of the opening as measured intermediate successive enlargements. The width of the enlargement should however be substantially greater than the width of the opening between enlargements and in practice, in width of the opening should be at least 50% greater than the width of the opening intermediate the enlargements. Thus for example, if the average width of the opening intermediate enlargements is 0.003 inches, then the width of the enlargement should of course be limited to a point where it does not provide substantially free flow of liquid into and out of the confined spaces so as to detract from the performance thereof in enhancement of boiling.

Referring first to FIGS. 1–7 there is shown in FIG. 1 a tube 10 having smooth interior surface 12 and provided on its exterior surface with fins indicated at 14. As better illustrated in the enlargement of FIG. 2, each of the fins 14 extends outwardly from the outer generally cylindrical surface 16 of the tube 10 to a height designated at $h$ which is at least several times greater than the average thickness of a fin as designated at $t$. As seen in this Figure, as well as FIGS. 5–10, the spacing between adjacent fin convolutions substantially exceeds the average fin thickness $t$. The tubing may be of different sizes and materials, but a typical operation employs thin wall copper tube having an initial O.D. of 0.5 to 1.0 inches.

Finned tubing of the type illustrated in FIGS. 1 and 2 is effectively produced as is well known by rolling the material of the fins upwardly out of the material of the tubing so as to produce a unitary integral finned tube. The fins may be in the form of independent circular convolutions, or, as is usually the case, the fins may be produced to extend helically about the tube. In addition, the fins may comprise a single helical fin or two or more interleaved helical fins.

With the finned tubing as illustrated in FIGS. 1 and 2, the fin convolutions are of uniform height so that the crests of multiplicity of fin convolutions substantially occupy an imaginary cylindrical surface.

In accordance with the present invention, the height of the fins is reduced at circumferentially spaced points as suggested in FIG. 3. In this Figure the tube 10 shows the fins 14 as having circumferentially spaced notches or recesses 18. As illustrated in the Figure these notches are generally of V-shaped configuration and have a depth reaching only to a small fraction of the total height *h* of the fin, as for example about 10–20% thereof. These notches are spaced substantially apart so that the enlargement of the continuous opening into the interior of the confined space provided at the exterior of the tubing constitutes only a small fraction of the total length of the opening, as for example between 10–30% thereof.

The notches or recesses 18 may be provided in the finned tube by rolling with a knurling tool in a direction longitudinally of the tube so as to displace the material from the crests of the fins and so provide the notches. Alternatively, the notches 18 may be produced by an operation in which the material at the crests of the fins is removed, as for example by a suitable cutting or grinding operation.

After providing the fin convolutions 14 with the circumferentially spaced notches 18 the tubing of the present invention is produced by simply drawing the finned tube through a die having a circular opening dimensioned to produce the required bending over of the fins to the configuration illustrated in FIGS. 4–7. Here, the bent over fins are designated 20, each provided with the notches or recesses 18. The crest 22 of each fin is bent over so as to be spaced very slightly from the side of the next adjacent fin convolution, thus providing the continuous opening designated 24 in FIG. 6 with the periodic enlargements designated 26 in FIG. 5 formed by the notches or recesses 18, communicating with the substantially enclosed space 27.

The cross-sectional configuration of the partially enclosed generally circumferentially or helically extending space between adjacent bent over fins is best seen in FIG. 7. This cross-sectional shape is substantially uniform both at points where the opening 24 is of minimum width and at points where it is enlarged by the notches on recesses 18 or 46. Moreover, since modern finning technique provides for dimensional control and spacing of fins, and production of fins of substantially uniform cross-section, it is possible to provide circumferentially or helically partially confined spaces the cross-sectional shape and dimensions of which are readily controlled and are substantially uniform throughout. Similarly, the notches or recesses 18 or 46 are of uniform shape, dimensions and spacing, and hence the openings into the partially confined spaces are substantially uniform as to the width thereof, and the dimensions and separations between the enlargements thereof as formed by the notches or recesses are also substantially uniform.

Referring now to FIGS. 8–11 there is illustrated another and preferred embodiment of the present invention. This embodiment of the invention is characterized by the production of externally finned internally ridged or ribbed tubing, as disclosed in Rieger U.S. Pat. No. 3,768,291, assigned to assignee herein. In this case a plain tube is advanced over a mandrel having one or more helically extending grooves therein, the grooves extending at a substantial lead or helix angle to the axis of the mandrel. The rolling operation is carried out by a multiplicity of sets of finning discs which are positioned with their axes crossed with respect to the mandrel and the tubing advancing thereover so as to press the tubing down firmly into engagement with the mandrel and actually to extrude material of the tubing into the groove or grooves provided in the mandrel as the tubing advances. For this purpose the mandrel is mounted for rotation so that as the finned tubing advances over the mandrel one or more helical internal ridges or ribs is produced.

The finning operation, where carried out on a plain cylindrical mandrel, produces fin convolutions which are of substantially constant height. Where, however, the mandrel is provided with the helical groove or grooves as disclosed in the Rieger patent, the portion of the fin convolution overlying the ridge or rib provided at the interior of the tubing is of slightly less height. This variation in height, as a structural feature of the tubing produced by the Rieger patent, is of no practical significance. However, as applied in the present invention, this very slight reduction in height at circumferentially spaced points on the crests or tips of the fin convolutions provides for periodic enlargement of the continuous opening providing access into the interior of the confined space when these fins are bent over by a drawing operation as previously disclosed.

Referring now to FIG. 8 there is illustrated a portion of tubing 30 provided at its interior surface with helically extending ridge or rib convolutions 32, which as seen in the Figure have a radially inward projection somewhat less than the axial width thereof. Ribs 32 extend at a substantial helix angle with respect to the axis of the tube diameter 34, as for example, an angle of 30°–45°. The fins 36 usually extend substantially circumferentially with the result that each internal rib convolution is intersected by a large multiplicity of fin convolutions. Where each fin convolution at the exterior of the tube crosses a fin convolution at the interior of the tube, the height of the fin will be reduced by a few thousandths of an inch.

Referring now to FIG. 9 the tube 30 is shown as provided with the internal rib convolutions 32 and with the external fins 36. Construction line 38 is drawn in this Figure through the crests of the fins **36*a* at points where these fins do not overlie the internal ribs 32. Where fins such as designated 36*b* overlie the internal ribs, it will be observed that these fins are of reduced height and are spaced inwardly from the construction line 38 by a dimension designated 40**.

Referring now to FIG. 10 the tube 30 is illustrated in the condition produced by drawing the finned tube illustrated in FIG. 9 through a circular die. The fins 36 are all displaced laterally to bring the crests thereof into position spaced slightly from the next adjacent fin convolution to define therewith the generally circumferentially extending confined space 42 and the elongated continuous circumferentially extending access opening 44 into the space. Where the fins are of reduced height as indicated at 36b, there is an enlargement in the continuous opening, this enlargement being designated in FIG. 10 at 46.

The completed tube is illustrated in the fragmentary elevational view of FIG. 11 where the bent over fin convolutions designated generally at 36 show widely separated enlargements 46 which are arranged in a helical pattern as indicated by the construction line 48 to extend at the same helix as the internal ridges or ribs 32. As seen in this Figure the internal ridges or ribs 32 extend at an angle of about 45° to the axis of the tube, while the fins 36 extend at an angle of about 80° to the tube axis or about 10° to planes perpendicular to the tube axis.

What I claim as my invention is:

1. Heat transfer tubing modified for the enhancement of heat transfer to liquid in contact with the exterior surface thereof in submerged boiling applications, said tubing having a multiplicity of helically extending axially spaced fin convolutions extending around said tubing, said tubing having a continuous cylindrical wall, said fin convolutions having inner base portions extending generally radially outwardly from said wall and having outer portions inclined towards the side of the adjacent convolutions to define therewith partially enclosed spaces of substantially uniform cross-section extending around the tubing, the transverse dimensions of said fin convolutions measured from the base to the tips thereof being substantially uniform except for a plurality of uniformly circumferentially spaced recesses extending inwardly from the tips of said convolutions, said recesses in total occupying 10–30% of the circumferential extent of said fin convolutions, the outer tips of said convolutions being closely spaced from the sides of adjacent convolutions to define therewith effectively continuous circumferentially extending elongated restricted openings communicating with said spaces, said openings having an average substantially uniform width intermediate said recesses of not more than 0.007 inches, said recesses defining with the side walls of adjacent fin convolutions enlargements in said continuous openings having a width at least 50% greater than the average width of opening intermediate said enlargements.

2. Tubing as defined in claim 1 in which all of said enlargements are of substantially uniform shape and dimensions.

3. Tubing as defined in claim 1 in which said recesses extend inwardly from the tip of said fins 10–20% of the width of said fins measured from root to tip.

4. Tubing as defined in claim 1 in which said elongated restricted openings intermediate said enlargements have an average width of not more than 0.005 inches.

5. Tubing as defined in claim 4 in which said elongated restricted opening intermediate said enlargements have an average width of 0.001–0.005 inches.

6. Tubing as defined in claim 1 in which said tubing is provided with internal helically extending ribs which extend at a helix angle of less than 45° measured with respect to the tube axis.

7. Tubing as defined in claim 6 in which the helix angle of said fins is related to the helix angle of said ribs such that each rib convolution extends axially of the tube to cross a multiplicity of fin convolutions.

8. Tubing as defined in claim 6 in which the series of enlargements of said restricted openings occupy helical paths conforming to the internal helical ribs.

9. Heat transfer tubing modified for the enhancement of heat transfer to liquid in contact with the exterior surface thereof in submerged boiling applications, said tubing having a multiplicity of helically extending axially spaced fin convolutions formed up out of the material of the tubing to a height and at an axial spacing between adjacent convolutions which provide for inclining the tip of the fin convolutions into close proximity with the sides of adjacent fin convolutions, said tubing having a continuous cylindrical wall, said fin convolutions having base portions extending generally radially outwardly from said wall and having outer portions inclined toward the sides of the adjacent convolutions to define therewith helically extending substantially enclosed spaces of substantially uniform cross-section extending around the tubing, the transverse dimension of the fin convolutions measured from the base to the tip thereof being substantially uniform except for a plurality of circumferentially uniformly spaced recesses extending inwardly from the tips of said convolutions, said recesses in total occupying 10–30% of the circumferential extent of said fin convolutions, the tips of said convolutions being closely spaced from the sides of adjacent convolutions to define therewith effectively continuous circumferentially extending elongated restricted openings communicating with said spaces, said openings having an average width intermediate said recesses of 0.001–0.005 inches, said recesses defining with the side wall of adjacent convolutions enlargements in said continuous openings having a width at least 50% greater than the average width of opening intermediate said enlargements, said tubing having internal helically extending ribs having a much smaller helix angle measured with respect to the tube axis than said helical fin convolutions so that each internal rib crosses a multiplicity of external fin convolutions in a helical path, said recesses in the tips of said fin convolutions being located opposite the point where the fin convolutions cross the internal ribs.

* * * * *